United States Patent [19]

Keaton

[11] 4,316,411

[45] Feb. 23, 1982

[54] HYDRAULIC CONTINUOUS PRESS

[76] Inventor: Clyde D. Keaton, 48 Dickinson St., Woodstown, N.J. 08098

[21] Appl. No.: 104,328

[22] Filed: Dec. 17, 1979

[51] Int. Cl.[3] ..... B30B 15/16; B30B 5/06

[52] U.S. Cl. ..... 100/50; 100/154; 100/211; 156/583.5; 198/832; 198/626; 425/371

[58] Field of Search ..... 100/151, 154, 93 R, 100/93 RP, 50, 211; 198/776, 832, 626, 737; 425/364, 371, 394, 406; 156/583.5

[56] References Cited

U.S. PATENT DOCUMENTS

| | | | |
|---|---|---|---|
| 2,071,999 | 2/1937 | Dike | 144/242 R |
| 2,289,022 | 7/1942 | Maurer | 198/776 |
| 2,340,607 | 2/1944 | Maurer | 100/93 P |
| 3,577,304 | 5/1971 | Guyer | 100/151 |
| 3,850,213 | 11/1974 | Keaton | 100/154 |
| 3,943,025 | 3/1976 | Russell | 156/583.5 |

*Primary Examiner*—Peter Feldman

*Attorney, Agent, or Firm*—Reising, Ethington, Barnard, Perry & Brooks

[57] ABSTRACT

A continuous press is disclosed for simultaneously pressing and conveying a workpiece, such as the laminations for making plywood, through the press in a continuous manner. The press comprises opposed sets of presser-conveyor rails which are spaced apart to receive a workpiece therebetween. The rails are mounted upon hydraulic actuators, one set of actuators for transverse motion of the rails and another set of actuators for longitudinal actuation of the rails. Each set of rails drives a separate caterpillar belt and the workpiece is interposed between the belts. The hydraulic actuators are energized in a sequence so that the rails maintain continuous pressing action through the belts and the belts maintain continuous conveyor action.

11 Claims, 8 Drawing Figures

HYDRAULIC CONTINUOUS PRESS

FIELD OF THE INVENTION

This invention relates to apparatus for simultaneously pressing and conveying a workpiece; more particularly, this invention relates to an hydraulically actuated continuous press.

BACKGROUND ART

There are numerous industrial operations which could be efficiently performed by a continuous press capable of applying pressure continuously to a workpiece while the workpiece is conveyed through the press. An example of such industrial operations includes the manufacture of laminated board or composition particle board which is typically performed by a batch process. There is a need for a continuous press which is capable of applying high pressure uniformly over the surface of a workpiece while the workpiece is continuously moved through the press.

A continuous press adapted for industrial processes of the aforementioned type is set forth in my U.S. Pat. No. 3,850,213. That patent discloses a continuous press comprising upper and lower platens which support opposed sets of presser-conveyer rails by means of plural cams which are rotatably mounted on the platen. Each set of rails drives a caterpillar belt and a sheet belt which encircle the platen supporting the set of rails. The workpiece is interposed between the sheet belts. The rails in each set are divided into plural groups and the supporting cams impart orbital motion to the rails in a polyphase arrangement, i.e., the motion of each group of rails is phase displaced from the motion of each other group of rails. The corresponding groups of rails in the two opposed sets are actuated synchronously and the workpiece is pressed and advanced first by one group of rails in each set, then by another group of rails in each set. While this arrangement is capable of providing uniformly distributed, high pressure over the workpiece and a desired feed rate, it relies upon mechanical actuation through the sliding friction of rotating cams.

Another type of continuous press known in the prior art utilizes a pair of oppositely rotating chains of platens which are spaced apart to receive a workpiece therebetween. The platens are aligned in the direction of movement and are driven continuously over guide rollers or sprockets. Pressure is applied by hydraulic means to compress the workpiece between the opposed platens and an anti-friction roller belt is provided on the back side of each chain of platens to provide a roller type bearing. Such apparatus is disclosed in the U.S. Pat. No. 2,071,999 and also in the U.S. Pat. No. 2,490,819.

Another continuous press utilizes two oppositely disposed sets of parallel bars with the bar of each set extending in the direction of travel of the workpiece through the press. The workpiece is compressed between a pair of bars, one from each set, during a forward stroke of the pair of bars and then is compressed between a second pair of bars, one from each set, during a forward stroke of the second pair of bars. The bars of the first pair are caused to separate and relieve pressure on the workpiece and to make a return stroke during the forward stroke of the second pair. Similarly, the second pair of bars makes a return stroke during the forward stroke of the first pair. Apparatus of this type is set forth in the U.S. Pat. No. 2,340,607 wherein the bars are driven in the forward stroke by friction drive rollers and are released by the rollers at a flat spot thereon for a return stroke under the influence of a retracting spring. Another continuous press of this type is disclosed in the U.S. Pat. No. 2,289,022 wherein selected bars from the upper and lower set of bars are moved toward each other for compressing the workpiece therebetween by means of a cam and follower arrangement and the same bars are moved in a forward and return stroke on a common carriage which is actuated by a separate cam and follower arrangement.

Another prior art apparatus using the reciprocating bar arrangement is shown in the U.S. Pat. No. 3,577,304. In the apparatus of this patent, a pair of opposed lifter bars are spaced apart to accept the workpiece therebetween and are mounted upon oppositely rotating eccentrics. Upon each rotation of the eccentrics the lifter bars successively compress the workpiece therebetween and impart a forward motion to it; at the end of the forward stroke the lifter bars open and a pair of holding bars are closed thereagainst by spring pressure to maintain compression of the workpiece in a dwell-condition while the lifter bars make a return stroke.

Another type of continuous press utilizes sliding friction to obtain a large bearing area for support of the moving press members. In this type of apparatus a pair of endless belts are disposed opposite each other and each is mounted on suitable drive rollers. The portions of the endless belts which are disposed in opposition and which receive the workpiece therebetween are respectively backed by rigid plates which in turn are supported by hydraulic plungers. To reduce the sliding friction the sheet of material having a low coefficient of friction is interposed between the moving belts and the respective backing plates. A continuous press of this type is shown in the U.S. Pat. No. 3,680,476.

A general object of this invention is to provide a continuous press which overcomes certain disadvantages of the prior art.

SUMMARY OF THE INVENTION

In accordance with this invention, apparatus is provided for simultaneously pressing and conveying a workpiece by independently controlling motion components of individual presser-conveyor rails in a press member. This is accomplished by a press member including a set of movable rails with hydraulic means for alternately actuating first and second groups of the rails in a cyclical motion for continually pressing and advancing the workpiece. A second press member, preferably of the same arrangement as the first is disposed oppositely thereof and is actuated in synchronism as a mirror image of the motion of the first press member. The motion of each rail is produced by the combination of a transverse actuating means and a longitudinal actuating means operating under a control means for coordinating the components of motion along the respective axes. In one embodiment, both the transverse actuating means and the longitudinal actuating means take the form of hydraulic pistons. In another embodiment, the transverse actuating means take the form of collapsible hoses.

More specifically, the invention comprises first and second oppositely disposed press members each including a set of rails in spaced relation and adapted to accept a workpiece therebetween. In each set of rails, first and second transverse actuating means are connected respectively with first and second groups of rails and are adapted to alternately advance and retract the first and second groups of rails relative to the set of rails in the other press member to alternately press and release the workpiece between the press members. Also, in each set of rails, first and second longitudinal actuating means are connected respectively with the first and second groups of rails and are adapted for alternately advancing and retracting the first and second groups of rails to move the workpiece toward the output of the press. Energizing means are provided for energizing the first transverse actuating means and the first longitudinal actuating means of the first groups of rails in the advancing direction while energizing the second transverse actuating means and the second longitudinal actuating means of the second groups of rails in the retracting direction, and vice versa, whereby the workpiece is continuously pressed while it is advanced between the input and the output of the press. An endless track including a link belt and a sheet belt encircle each set of rails so that the workpiece is engaged by the sheet belt and the force of the rails is imparted through the link belt and the sheet belt to the workpiece. The control means for advancing and retracting the rails comprises means for energizing the longitudinal actuating means in the advancing direction in response to a predetermined hydraulic pressure in the transverse actuating means and for energizing the longitudinal actuating means in a retracting direction simultaneously with the transverse actuating means. The control means is adapted to energize the transverse actuating means and the longitudinal actuating means in the retracting direction in response to a predetermined hydraulic pressure in the longitudinal actuating means. Further, the retracting means includes means for restricting the flow rate to the longitudinal actuating means and the transverse actuating means when they are energized in the retracting direction.

A more complete understanding of this invention may be obtained from the detailed description that follows taken with the accompanying drawings.

BEST MODE FOR CARRYING OUT THE INVENTION

Figure 1:
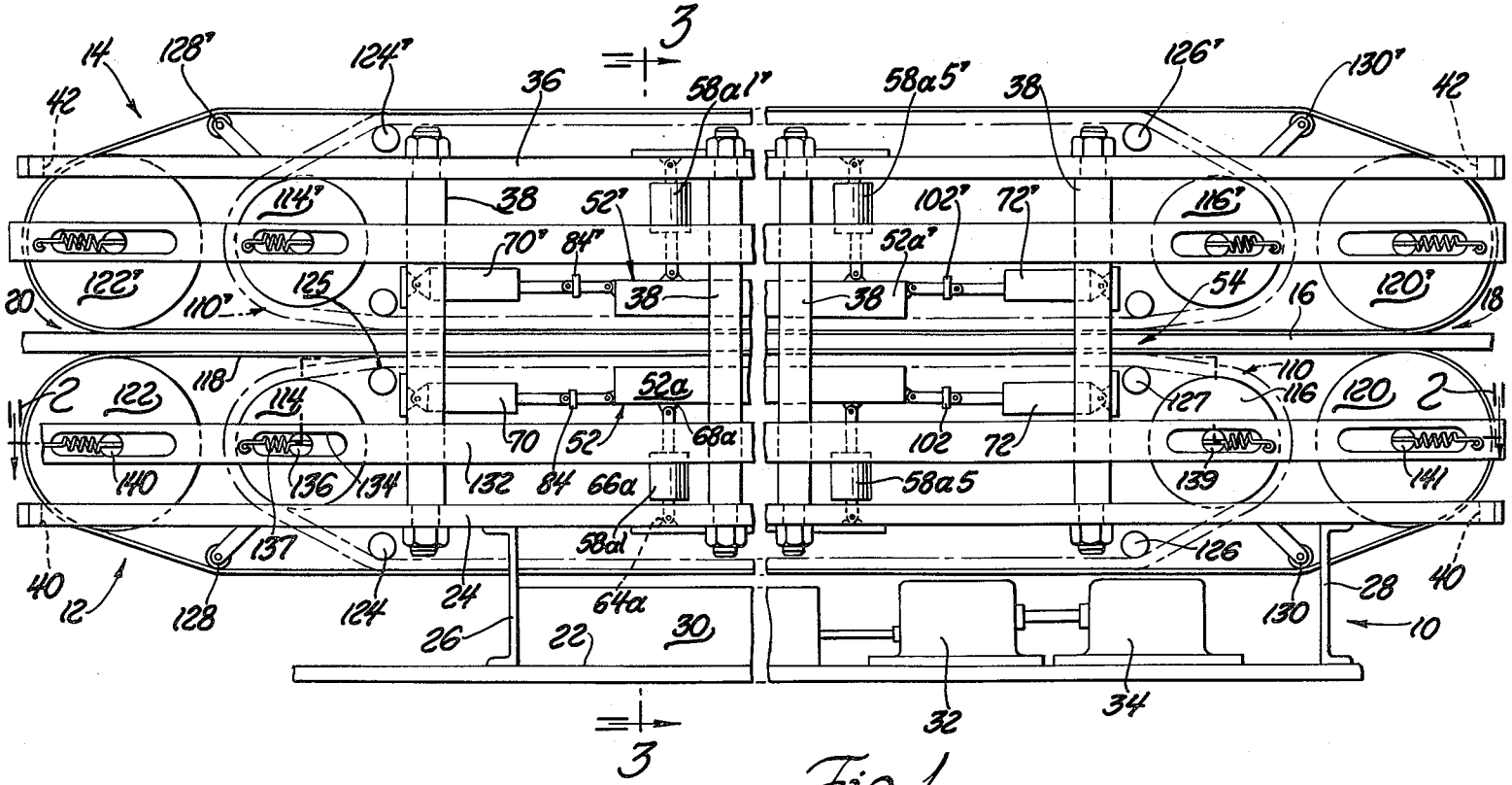
FIG. 1 is a view in elevation of the apparatus of a first embodiment of this invention.

Referring now to the drawings, there is shown an illustrative embodiment of the invention in a continuous press for simultaneously pressing and conveying a workpiece. It will be appreciated, as the description proceeds, that the invention may be employed in a wide variety of applications. It may be used in applications where extremely high pressures are required and where heat treatment or curing of the workpiece is required. Typical applications of the continuous press include the manufacture of large plywood sheets on a continuous basis where the workpiece is relatively thick and wide and moderately high pressure is required, together with elevated temperature for curing. A typical application for a small workpiece is that of manufacturing phenolic circuit boards which require extremely high pressures and precise thickness control. It will be understood that a temperature control system may be incorporated in the press of this invention, such as that disclosed in my U.S. Pat. No. 3,850,213 and the disclosure thereof is hereby incorporated by reference.

As shown in FIG. 1, the continuous press comprises, in general, a stationary frame 10 which supports a lower press member 12 and a substantially identical upper press member 14. The press members 12 and 14 are disposed oppositely each other and are adapted to receive a workpiece 16 in the space therebetween at an input 18 of the press and to discharge the workpiece at an output 20 of the press.

The frame 10 comprises a horizontal base plate 22 having a lower platen 24 mounted thereon by a pair of spaced headers 26 and 28. This arrangement provides a base compartment which suitably houses a fluid reservoir 30, a pump 32 and a motor 34 for the hydraulic system of the press. An upper platen 36 is fixedly mounted on the lower platen 24 by front and rear sets of columns 38, the front set being shown in FIG. 1 and the rear set being hidden but in the same arrangement as the front set. It is noted that the lower platen 24 is a flat steel plate having a rectangular opening 40 extending the full length and width thereof, for reasons which will appear subsequently. Similarly, the upper platen 36 is provided with a rectangular opening 42.

As noted above, the lower and upper press members 12 and 14 are substantially identical to each other; therefore, only the lower press member 12 will be described in detail. The corresponding parts of the upper press member 14 will be identified using the same reference characters but with a prime symbol. The lower press member comprises a first set of presser-conveyor rails 52, such rails being divided into two groups, namely, rails 52*a*, 52*c*, 52*e* and 52*g* in the first group and rails 52*b*, 52*d*, 52*f* and 52*h* in the second group. Each of the rails is suitably rectangular in cross section and extends throughout the length of the throat 54 of the press. The rails are disposed parallel to each other in closely spaced relationship and are adapted for independent movement, as will be discussed subsequently. Each rail is suitably provided with fluid passages 56 to permit temperature control of the rails for heating or curing of the workpiece, as desired.

Figure 2:
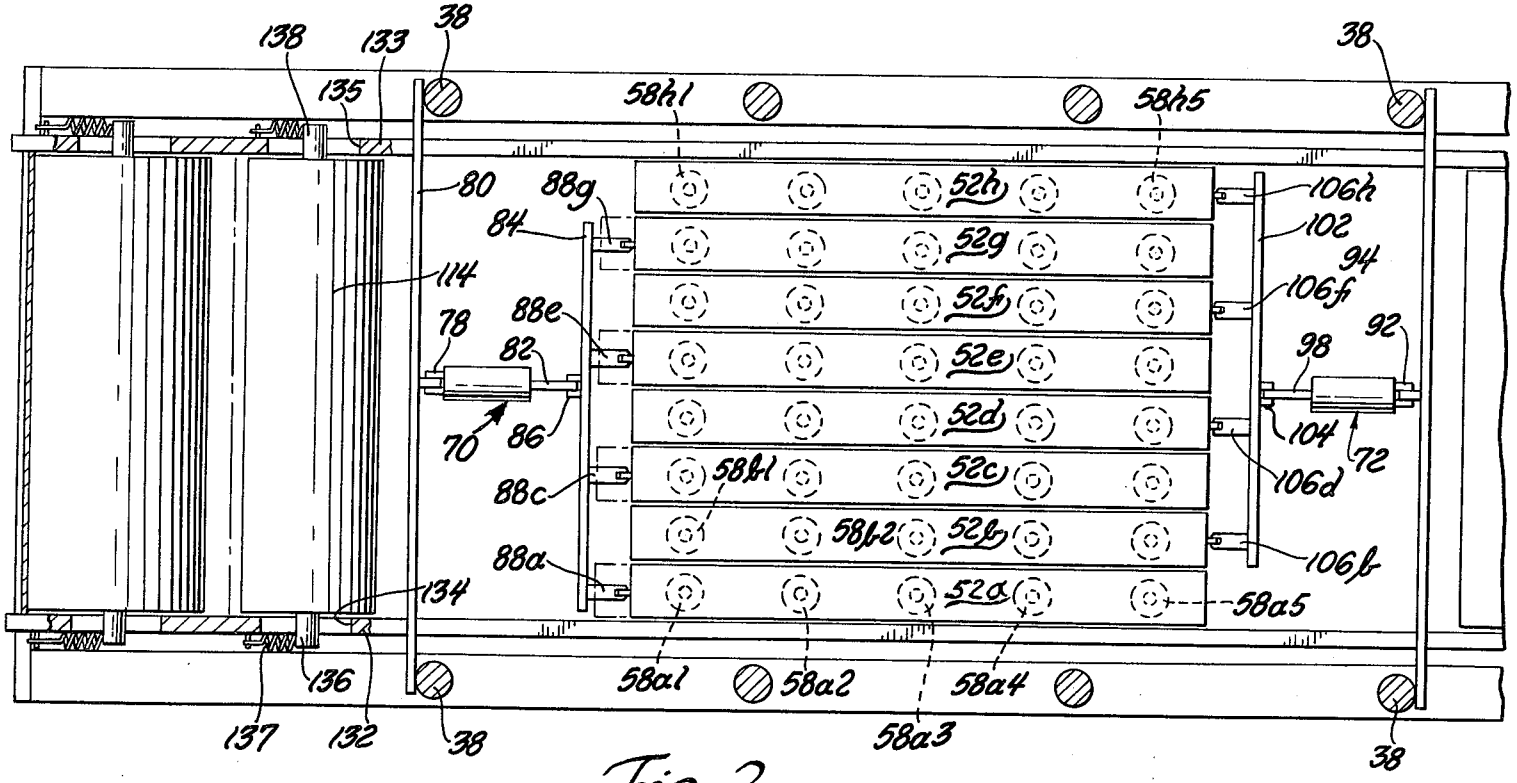
FIG. 2 is a view taken on lines 2—2 of FIG. 1.
Figure 3:
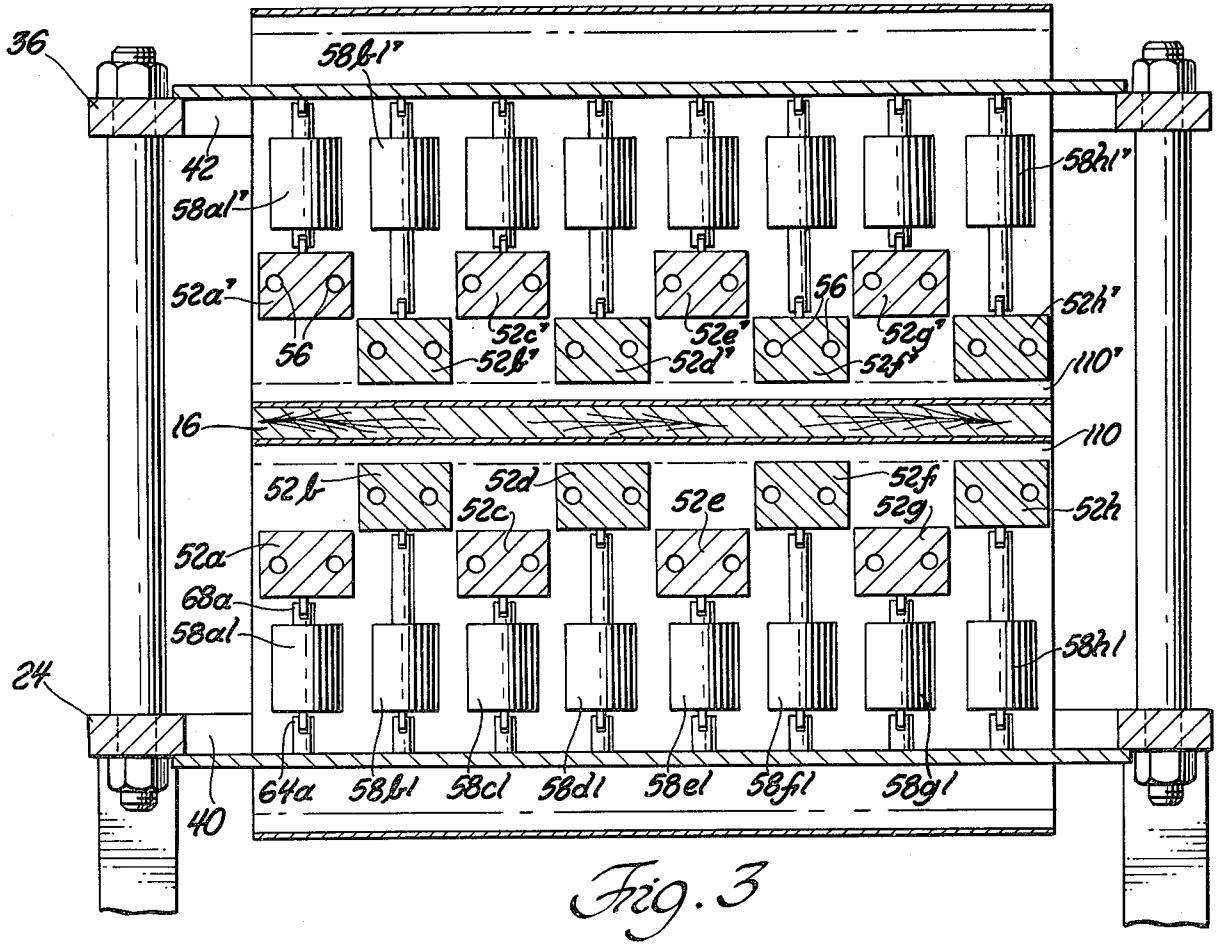
FIG. 3 is a view taken on lines 3—3 of FIG. 1.

Each rail is supported upon the lower platen 24 by plural hydraulic actuators; for example, rail 52*a* is supported by actuators 58*a*1, 58*a*2, 58*a*3, 58*a*4 and 58*a*5. The hydraulic actuator 58*a*, as shown in FIGS. 1 and 2, takes the form of a cylinder and piston. The cylinder is connected with the lower platen 24 by a pivot coupling 64*a* so that the cylinder is freely pivotable in the longitudinal direction of the rail 52*a*. The piston is connected through a piston rod 66*a* to the rail 52*a* by a pivot coupling 68*a* so that the piston is free to pivot relative to the rail in the longitudinal direction thereof. Thus, each rail, for example rail 52*a*, is mounted on the respective hydraulic actuators to that it is adapted for alternate advancing and retracting motion relative to the opposed rail 52*a*′ by reversing the energization of the actuators.

In order to provide for longitudinal actuation of the rails, longitudinal hydraulic actuators 70 and 72 are provided. The actuator 70 comprises a cylinder and a piston with the cylinder connected by a pivot coupling 78 with a vertically disposed mounting plate 80 which is secured to the columns 38. The piston is connected by a piston rod 82 with an actuator bar 84 by a pivot coupling 86. The actuator bar 84 is connected with alternate rails 52*a*, 52*c*, 52*e* and 52*g* through respective rods 88*a*, 88*c*, 88*e* and 88*g*, each of which is connected with the respective rail by a pivot coupling. In a similar manner, the longitudinal hydraulic actuator 72 is adapted to actuate alternate rails 52*b*, 52*d*, 52*f* and 52*h* in the longitudinal direction. For this purpose, the cylinder is connected by a pivot coupling 92 with a vertically extending mounting plate 94, which is secured to the columns 38. The piston is connected through a piston rod 98 to an actuator bar 102 by a pivot coupling 104. The actuator bar is connected with rails 52*b*, 52*d*, 52*f* and 52*h* by respective actuator rods 106*b*, 106*d*, 106*f* and 106*h* which are connected with the respective rails by pivot couplings. Thus, the rails of the lower press member are adapted for movement in alternately advancing and retracting directions relative to the output of the press by reversing the energization of the hydraulic actuators 70 and 72.

In order to apply uniformly distributed pressure to the workpiece, a track is interposed between the set of rails 52 and the workpiece 16. The track comprises an endless caterpillar belt 110, which encircles the set of rails 52 and is supported upon a pair of rollers 114 and 116 and on a pair of guide rollers 124 and 126 below the platen 24 and a pair of guide rollers 125 and 127 above the platen. The caterpillar belt 110 comprises a multiplicity of rigid bar links, each of which extends transversely of the press and spans the lower set of rails 52 in engagement therewith. The bar links are disposed edge to edge and each has a tapered cross section to provide clearance from the adjacent bar links in passing over the rollers 114 and 116. Each bar link is secured to the adjacent link by means of a coil spring (not shown) which draws the adjacent links together to provide a substantially uninterrupted surface. The track also comprises an endless sheet belt 118 which is disposed over the caterpillar belt 110 to provide a continuous and smooth facing to be presented to the workpiece. The sheet belt 118 is suitably constructed of stainless steel having a smooth and polished outer surface which engages the surface of the workpiece. The sheet belt 118 is supported by a pair of rollers 120 and 122 and by a pair of guide rollers 128 and 130. The track is propelled by the action of the set of rails 52 against the caterpillar belt 110, which is caused to rotate around the rollers 114 and 116. This motion of the caterpillar belt 110, in turn, propels the sheet belt 118 causing it to rotate around the supporting rollers 120 and 122. The action of the set of rails 52 will be described subsequently.

In order to maintain a substantially uniform tension in the track during the motion of the set of rails 52, the rollers 114 and 116 are adapted to move relative to the lower platen 24. The roller 114 is supported by a pair of oppositely disposed side bars 132 and 133 which are provided with slots 134 and 135, respectively (see FIGS. 1 and 2). The shaft 136 of the roller 114 has its opposite ends extending into the slots 134 and 135. The shaft 136 is spring loaded by tension springs 137 and 138 so that the roller 114 keeps the track under tension. Similarly, the roller 116 is supported by side bars 132 and 133 with its shaft 139 disposed in respective slots in the bars and spring loaded by tension springs. Thus, the roller 114 and the roller 116 are moved toward each other when any of the rails in the set of rails 52 is advanced toward the press member 14. This action causes the tension on the caterpillar belt 110 to remain substantially uniform during the movement of either group of rails in the set of rails 52. The sheet belt 118, as described above, is supported on the rollers 120 and 122 and the guide rollers 128 and 130. In order to allow for the movement of the sheet belt with the movement of the rails 52, the shafts 140 and 141 of the rollers 120 and 122, respectively, are mounted on the side bars 132 and 133 and spring loaded in a manner similar to rollers 114 and 116.

As noted above, the upper press member 14 is of the same construction as the press member 12 and is, of course, disposed in an inverted position opposite press member 12. Accordingly, no further description is necessary, it being noted that like parts are designated with like reference character except that the prime symbol is added to the reference characters for the parts of press member 14.

Figure 4:
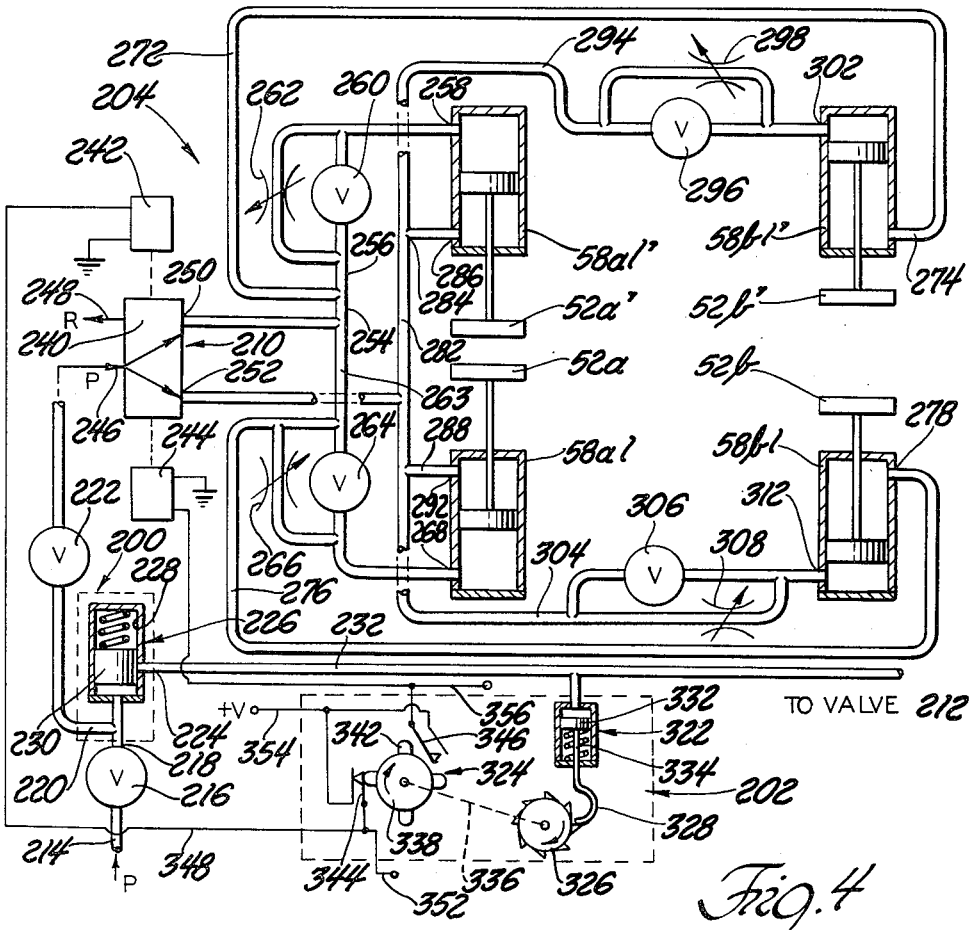
FIG. 4 is a schematic diagram of part of the control system.
Figure 5:
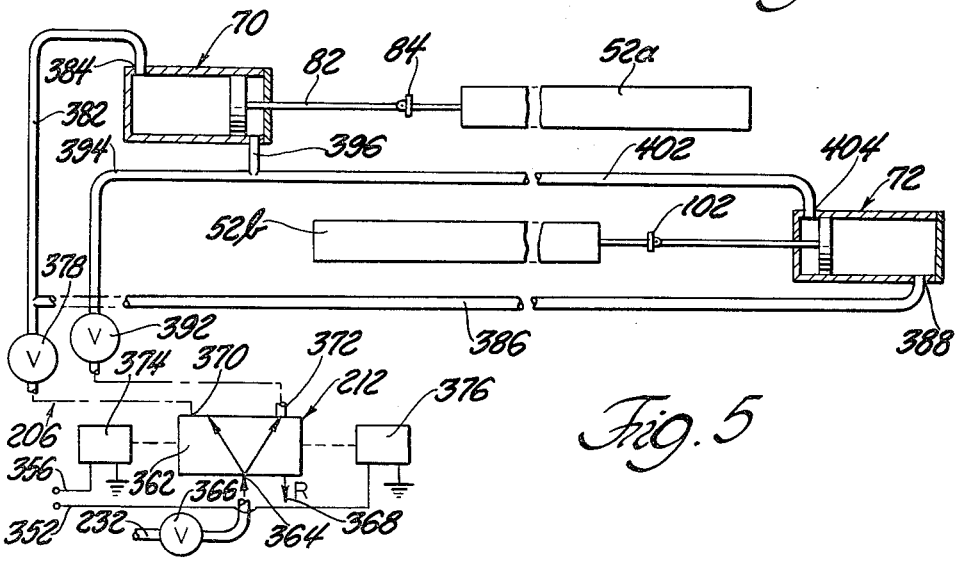
FIG. 5 is a schematic diagram of another part of the control system.

The control system for the continuous press is depicted in schematic fashion in FIGS. 4 and 5. For simplicity of explanation, FIG. 4 depicts only rails 52*a* and 52*b* in the lower press member 12, with rail 52*a* being representative of the first group of rails including 52*a*, 52*c*, 52*e* and 52*g* and with rail 52*b* being representative of the second set of rails including 52*b*, 52*d*, 52*f* and 52*h*. Similarly, only rails 52*a*′ and 52*b*′ are depicted in the upper press member with rail 52*a*′ being representative of the first group of rails including 52*a*′, 52*c*′, 52*e*′ and 52*g*′ and with rail 52*b*′ being representative of the second group of rails including 52*b*′, 52*d*′, 52*f*′ and 52*h*′. It is also noted that for the sake of simplicity in FIG. 4, rail 52*a*′ is supported by hydraulic actuator 58*a*1 only, it being understood that the remaining actuators 58*a*2 through 58*a*5 are connected to rail 52*a* in the same manner as actuator 58*a*1. The same holds for rail 52*b* and hydraulic actuator 58*b*1; for rail 52*a*′ and hydraulic actuator 58*a*1′; and for rail 52*b*′ and hydraulic actuator 58*b*1′.

Also, for the sake of simplicity of explanation, the longitudinal control system is depicted in FIG. 5 with only two rails 52*a* and 52*b* as being representative. Rail 52*a* in the lower press member 12 is representative of the first group of rails 52*a*, 52*c*, 52*e* and 52*g*. It is also representative of the first group of rails 52*a*′, 52*c*′, 52*e*′ and 52*g*′ in the upper press member 14 since the control for the first group of rails in the press member 14 is exactly the same as that for the first group of rails in the press member 12. Similarly, rail 52*b* is representative of the second group including rails 52*b*, 52*d*, 52*f* and 52*h* in the lower press member 12 and it is also representative of the second group of rails 52*b*′, 52*d*′, 52*f*′ and 52*h*′ in the upper press member 14.

The control system, in general, comprises a sequence valve 200 and a pressure responsive switch 202 which provide hydraulic pressure and control signals to a transverse control system 204 (see FIG. 4) and to a longitudinal control system 206 (see FIG. 5). The transverse control system comprises a reversing means including a solenoid valve 210 for the transverse actuators 58*a*1, 58*a*1′, 58*b*1 and 58*b*1′. Similarly, the longitudinal control system comprises reversing means including a solenoid valve 212 for reversing the energization of the hydraulic actuators 70 and 72.

The control system is supplied with hydraulic fluid pressure from the pump 32 through a supply conduit 214 and a check valve 216. The sequence valve 200 has an inlet port 218 and a first outlet port 220 in direct communication with the inlet port. The outlet port 220 is connected through a check valve 222 to the solenoid valve 210. The sequence valve 200 has a second outlet port 224 which is coupled with the inlet port 218 through a pressure responsive valve 226. The valve 226 comprises a cylinder 228 connected with inlet port 218 and with the second outlet port 224. A piston 230 is disposed within the cylinder 228 and is biased by a coil spring in a direction to close the outlet port 224. The port 224 is connected through a conduit 232 with the solenoid valve 212 of the longitudinal control system. The sequence valve 200 is set to open the outlet port 224 at a predetermined value of pressure which is equal the maximum value of pressure desired to be applied to the transverse hydraulic actuators 58*a*1, 58*a*1', 58*b*1 and 58*b*1'. The sequence valve 200 is operative to place the solenoid valve 210 of the transverse control system in direct communication with the supply conduit 214 at all times. However, it places the solenoid valve 212 of the longitudinal control system in communication with the supply conduit 214 only when the pressure in the supply conduit exceeds said predetermined value. The operation of the sequence valve along with the solenoid valves 210 and 212 and the pressure switch 202 will be discussed subsequently.

The solenoid valve 210 is of known construction and comprises a valve body 240, a first solenoid actuator 242 and a second solenoid actuator 244. The valve body 240 has a pressure inlet port 246 which is connected with a conduit 220 and a drain port 248 which is connected to the fluid sump (not shown). The valve also includes a port 250 and a port 252, either of which may be selectively connected with the pressure inlet port 246 or with the drain port 248. When the solenoid actuator 242 is energized and the solenoid 244 is deenergized, the port 250 is connected with the pressure inlet port 246 and the port 252 is connected with the drain port 248. In the reverse condition, with solenoid actuator 244 energized and solenoid actuator 242 deenergized, the port 252 is connected with the pressure inlet port 246 and the port 250 is connected with the drain port 248. The port 250 is coupled with the hydraulic actuator 58*a*1' through an hydraulic circuit which extends through a conduit 254, conduit 256, check valve 260 and a parallel connected adjustable flow restrictor 262 to the advance port 258 of the hydraulic actuator 58*a*1'. The port 250 of the solenoid valve is also coupled with the hydraulic actuator 58*a*1 through an hydraulic circuit which extends through a conduit 263, check valve 264 and a parallel connected adjustable flow restrictor 266 to an advance port 268 of the hydraulic actuator 58*a*1. The port 250 of the solenoid valve 210 is also coupled with the hydraulic actuator 58*b*1' through an hydraulic circuit which extends through the conduit 254 and a conduit 272 to the retract port 274 of the actuator 58*b*1'. The port 250 of the solenoid valve is also coupled with the hydraulic actuator 58*b*1 through an hydraulic circuit extending through the conduit 263 and a conduit 276 to the retract port 278 of the actuator 58*b*1.

The port 252 of the solenoid valve 210 is coupled with the hydraulic actuator 58*a*1' through an hydraulic circuit which extends through a conduit 282 and a conduit 284 to the retract port 286 of the actuator 58*a*1'. The port 252 is also coupled with the hydraulic actuator 58*a*1 through an hydraulic circuit which extends through the conduit 282 and a conduit 288 to a retract port 292 of the actuator 58*a*1. Also, the port 252 of the solenoid valve is coupled with the hydraulic actuator 58*b*1' through an hydraulic circuit extending through the conduit 282, a conduit 294, a check valve 296 and a parallel connected adjustable flow restrictor 298 to the advance port 302 of the actuator 58*b*1'. Also, the port 252 is coupled with the hydraulic actuator 58*b*1 through an hydraulic circuit extending through the conduit 282, a conduit 304, a check valve 306 and a parallel connected adjustable flow restrictor 308 to the advance port 312 of the actuator 58*b*1.

The solenoid valves 210 and 212 are controlled by the pressure responsive switch 202. This switch is actuated by pressure change in the conduit 232 and is adapted to perform a circuit switching function when pressure increases to a predetermined value. The pressure responsive switch 202 comprises, in general, a pressure actuated drive mechanism 322 and a switching device 324. The drive mechanism 322 includes a ratchet wheel 326 and a fluid pressure actuated pawl 328 coacting therewith for advancing the rotative position of the ratchet wheel one increment for each forward stroke of the pawl. The pawl 328 is advanced by a fluid piston 332 and is retracted by a coil spring 334. The rotation of the ratchet wheel 326 is imparted through a shaft 336 to a cam 338 in the switch device 324. The cam 338 has a plurality of lobes 342 adapted for actuation of a first switch 344 and a second switch 346. It is noted that the switch 344 is closed when the switch 346 is open, and vice versa, and that each stroke of the pawl 328 reverses the condition of the switches 344 and 346. The fixed contacts of the switches 344 and 346 are both connected with a voltage source +V. The movable contact of the switch 344 is connected through a conductor 348 with the solenoid actuator 242 of the solenoid valve 210; it is also connected through a conductor 352 with the solenoid valve 212 in a manner to be described subsequently. The movable contact of switch 346 is connected through a conductor 354 with the solenoid actuator 244 of the solenoid valve 210; it is also connected through a conductor 356 with the solenoid valve 212 in a manner to be described subsequently.

The longitudinal control system will now be described with reference to FIG. 5. The solenoid valve 212 is of the same construction as solenoid valve 210 and comprises a valve body 362 and a pair of solenoid actuators 374 and 376 for actuation thereof. The valve body 362 has a pressure inlet port 364 connected with the conduit 232 through a check valve 366. The valve body also has a drain port 368 connected with the sump. Additionally, the valve body 362 has a port 370 and a port 372. The port 370 is coupled with the hydraulic actuator 70 through an hydraulic circuit extending through a relief valve 378 and a conduit 382 to the retract port 384 of the actuator 70. The port 370 is also coupled with the hydraulic actuator 72 through an hydraulic circuit including the relief valve 378, a conduit 386 and the advance port 388 of the actuator 72. The port 372 of the valve body 362 is coupled with the hydraulic actuator 70 through an hydraulic circuit including a relief valve 392, a conduit 394 and the advance port 396 of the actuator 70. The port 372 is also coupled with the hydraulic actuator 72 through an hydraulic circuit including the relief valve 392, the conduit 394, a conduit 402 and the retract port 404 of the actuator 72.

The solenoid valve 212 is operative to connect the pressure supply port 364 with the port 370 when the solenoid 374 is energized and the solenoid 376 is deenergized. In this condition, the port 372 is connected with the drain port 368. When the solenoid 376 is energized and solenoid 374 is deenergized, the pressure supply port 364 is connected with the port 372 and the port 370 is connected with the drain port 368. The relief valves 378 and 392 are set to relieve the pressure in respective conduits 382 and 394 at a predetermined value of pressure which is higher than the operating point of the pressure responsive switch 202.

The operation of the first embodiment of the invention, as shown in FIGS. 1 through 5, will now be described. The description of operation will be given with reference to the coaction of the lower press member 12 and upper press member 14 (see FIG. 1), the lower press member including the set of rails 52 and the upper press member including the set of rails 52'. The set of rails 52 includes the first group of rails 52*a*, 52*c*, 52*e* and 52*g* and the second group of rails 52*b*, 52*d*, 52*f* and 52*h* (see FIGS. 2 and 3). Similarly, in the set of rails 52' the first group includes rails 52*a'*, 52*c'*, 52*e'* and 52*g'* and the second group includes rails 52*b'*, 52*d'*, 52*f'* and 52*h'* (see FIG. 2). It will be understood that all the rails in the first group of rails in the lower press member 12 move in unison and all the rails in the first group in the upper press member group move in unison with each other and in opposition to the movement of the first group in the lower press member. Similarly, all the rails in the second group in the lower press member move in unison and all the rails in the second group in the upper press member move in unison with each other and in opposition to the motion of the rails in the second group in the lower press member. Accordingly, in operation rails 52*a* and 52*a'* are representative of the first group of rails in the lower press member and the first group in the upper press member, respectively, and the rails 52*b* and 52*b'* are representative of the second group in the lower press member and the second group in the upper press member, respectively.

At the start of operation, it will be assumed that the pressure responsive switch 202 is in the condition shown in FIG. 4, i.e. switch 344 is closed and switch 346 is open. Accordingly, in the solenoid valve 210, the solenoid actuator 242 is energized and the solenoid actuator 244 is deenergized; in the solenoid valve 212, the solenoid actuator 376 is energized and the solenoid actuator 374 is deenergized. At start up, the hydraulic pressure in the pressure supply conduit 214 increases, after the pump starts, from an initially low value toward a higher value. This initiates the first half-cycle of operation. The pressure in the supply conduit 214 is applied directly through the sequence valve 200 to the inlet port 246 of the solenoid valve 210. With the valve energized as described above, the valve applies the hydraulic pressure from port 250 through the check valve 260 to the advance port 258 of hydraulic actuator 58*a*1' and to the advance port 268 of hydraulic actuator 58*a*1. The retract port 292 of actuator 58*a*1 and the retract port 286 of actuator 58*a*1' are connected to the sump through the valve port 252 of the solenoid valve 210. Accordingly, the rails 52*a* and 52*a'* advance toward the workpiece and and the workpiece is pressed between the tracks 110 and 110' of the lower and upper press members. In this state, the rails 52*b* and 52*b'* will be retracted from the workpiece; the retract port 278 of actuator 58*b*1 and the retract port 274 of actuator 58*b*1' receives hydraulic pressure from the valve port 250 and the advance port 312 of actuator 58*b*1 and the advance port 302 of actuator 58*b*1' are connected with the sump through the valve port 252.

As the press members are closed against the workpiece by the advancement of rails 52*a* and 52*a'*, the hydraulic pressure in the supply conduit 214 rises. At a predetermined value of pressure, the sequence valve 200 will open, i.e. the piston 230 will open the outlet port 224 and the supply pressure will be applied through conduit 232 to the inlet port 364 of the solenoid valve 212. With this valve in the condition described above, hydraulic pressure is applied from valve port 372 to the advance port 396 of the hydraulic actuator 70 and the retract port 384 thereof is connected to the sump through the valve port 370. Accordingly, the actuator 70 will advance the rail 52*a* (and the opposed rail 52*a'*) in the longitudinal direction toward the output of the press. At the same time, the hydraulic actuator 72 has its retract port 404 connected with the hydraulic pressure at valve port 372 and its advance port 388 connected with the sump through valve port 370 and the rail 52*b* (and the opposed rail 52*b'*) is retracted in the longitudinal direction from the output of the press. In the operational phase just described, the transverse hydraulic actuators 58*a*1 and 58*a*1' close the press (belts 110 and 110') against the workpiece and the longitudinal hydraulic actuators 70 and 70' move the belts 110 and 110' with the workpiece toward the output of the press. At the same time, the transverse hydraulic actuators 58*b*1 and 58*b*1' retract the rails 52*b* and 52*b'* away from the workpiece; it is noted, however, that the retraction is limited to a small displacement because of the flow restriction in the drain connection of the actuators 58*b*1 and 58*b*1'. In particular, the actuator 58*b*1' has the flow restrictor 298 connected between the advance port 302 and the valve port 252 and only a small amount of hydraulic fluid is drained from the actuator during the retract portion of the cycle. In the same way, the flow restrictor 308 is connected between the advance port 312 of actuator 58*b*1 and the valve port 252 and the same result obtains. Thus, the hydraulic actuators 58*b*1 and 58*b*1' are only partially dumped and refilled on alternate cycles of operation with the attendant advantage of reduced requirement for hydraulic flow capacity and faster response time. The same arrangement is provided for the hydraulic actuators 58*a*1 and 58*a*1' by the flow restrictors 266 and 262, respectively.

The rail 52*a* is advanced in the forward direction to the end of the actuator stroke. When the rail 52*a* is stopped, the hydraulic fluid pressure in the conduit 232 increases to a predetermined value which exceeds that which is required to actuate the pressure actuated pawl 322 in the pressure actuated switch 202. Accordingly, the ratchet wheel 326 and the cam 338 are advanced one increment. This opens the switch 344 and closes the switch 346. As a result, the energization of the solenoid valve 210 is reversed and the energization of the solenoid valve 212 is reversed. This completes the first half-cycle of operation of the press and it is now in condition for execution of the second half-cycle.

At the initiation of the second half-cycle of the press, the solenoid valve 210 will have the solenoid actuator 244 energized and the solenoid actuator 242 deenergized. The solenoid valve 212 will have the solenoid actuator 374 energized and the solenoid actuator 376 deenergized. The sequence valve 200 will be reset with the piston 230 closing the outlet port 224 because of the pressure drop in the supply conduit 214 which occurs upon reversal of the solenoid valves 210 and 212. Accordingly, with solenoid valve 210 in the state just described, the transverse hydraulic actuators **58*b*1 and 58*b*1' will be energized to advance the rails 52*b* and 52*b*' toward the workpiece. At the same time, the transverse hydraulic actuator 58*a*1 and 58*a*1' will be energized to retract the rails 52*a* and 52*a*' from the workpiece. Thus, the upper and lower press members will be closed by the advancement of rails 52*b* and 52*b*' against the tracks 110 and 110' which engage the workpiece. This causes the hydraulic pressure in the supply conduit 214 to increase and the sequence valve 200 is actuated so that the supply pressure from conduit 214 is applied through the valve and through conduit 232 to the inlet port 364 of the solenoid valve 212. With this solenoid valve in the condition just described, the longitudinal hydraulic actuator 70 will be energized to retract the rail 52*a* (in the same manner, hydraulic actuator 70' will be energized to retract the rail 52*a*'). At the same time, hydraulic actuator 72 will be energized to advance the rail 52*b* (in the same manner, actuator 72' will be energized to advance the rail 52*b*'). Thus, the motion of the rails 52*b* and 52*b*' in longitudinal direction will advance the belts 110 and 110' and the workpiece will be moved toward the output of the press. When the rail 52*b* is advanced to the end of the actuator stroke, the fluid pressure in the supply conduit 214 will rise to a value which exceeds the predetermined value at which the pressure actuated pawl 322 is actuated. The actuation of the pawl will advance the cam 338 one increment of rotation and the switch 344 will be closed and switch 346 will be opened. This is effective to reverse the energization of the solenoid valves 310 and 312** once again, and thus completes the execution of the second half-cycle of operation. The press is now in readiness for the initiation of the next half-cycle, i.e. the repetition of the first half-cycle which was described above. This operation continues so long as the press remains energized and consequently the workpiece is continuously pressed between the upper and lower press members while it is fed therebetween from the input to the output of the press.

Figure 6:
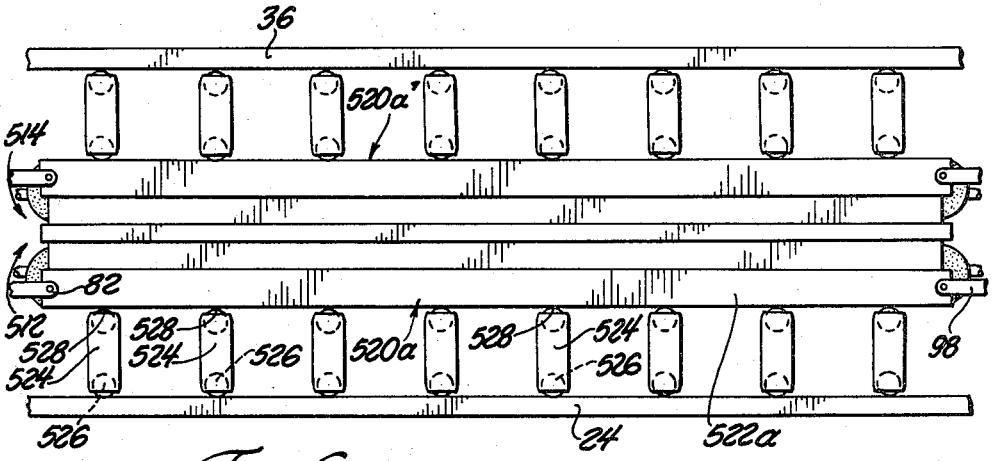
FIG. 6 is a fragmentary view in elevation of a second embodiment of the subject invention.
Figure 7:
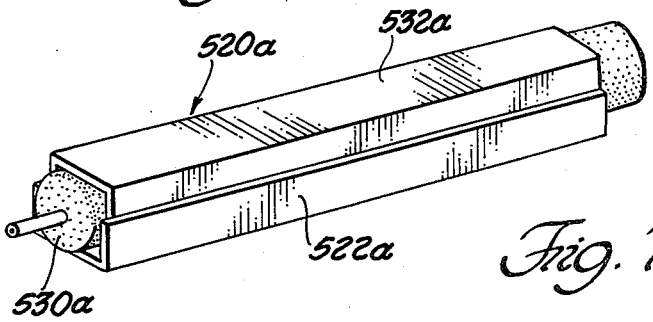
FIG. 7 shows a detail of construction of the second embodiment.
Figure 8:
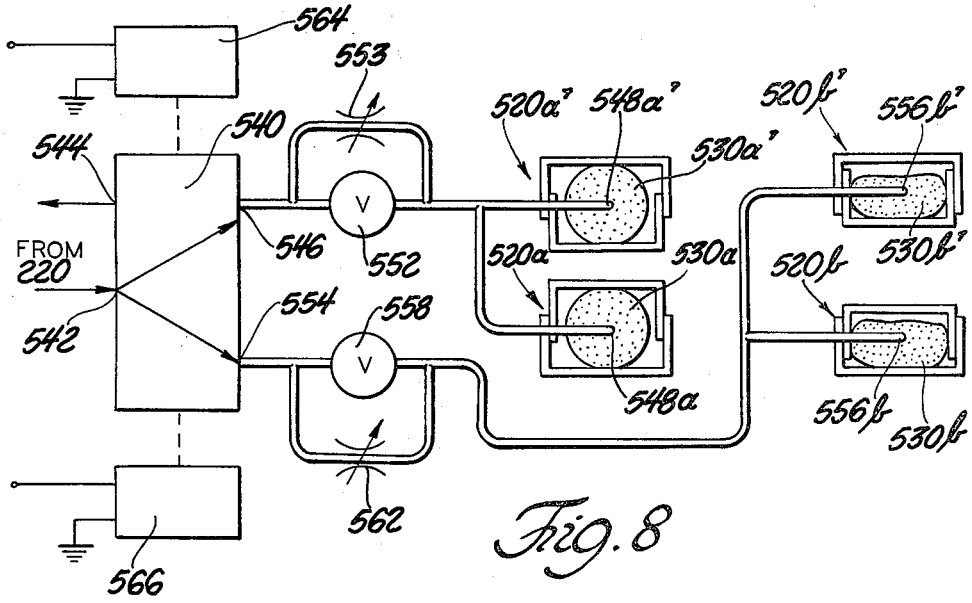
FIG. 8 is a schematic diagram of part of the control system for the second embodiment.

A second embodiment of the invention is shown in FIGS. 6, 7 and 8. In this embodiment, the longitudinal actuating and control system is the same as that described in the first embodiment shown in FIGS. 1 through 5; however, the transverse actuating and control system is different. As shown in FIG. 6, the press comprises a lower press member 512 and an upper press member 514. Each press member preferably comprises a set of presser-conveyor rails in the same manner as the first embodiment; each set of rails is divided into first and second groups as in the first embodiment. For simplicity, FIG. 6 shows a rail **520*a* which represents the first group of rails in the lower press member and a rail 520*a*' which represents the first group of rails in the upper press member. The rail 520*a*' is identical to rail 520*a* except that it is inverted and hence only rail 520*a* will be described in detail. Rail 520*a* comprises a support channel 522*a* which is mounted upon the lower platen 24 by a set of pivot arms 524. Each pivot arm 524 is seated at its lower end on a pivot shaft 526 secured to the platen 24; at its upper end, each pivot arm 524 receives a pivot shaft 528 which is secured to the support channel 522*a***. Thus, each rail is adapted to be advanced and retracted in the longitudinal direction by the same hydraulic actuators as described with reference to the first embodiment.

In order to advance and retract each rail, such as rail **520*a*, in the transverse direction, the rail additionally comprises an hydraulic actuator in the form of a hose 530*a* which is disposed within the support channel 522*a* and extends substantially the full length thereof. An elongated piston 532*a*, in the form of an inverted channel is disposed over the hose 530*a* in nesting relation to the support channel 522*a*. The hose 530*a* has a collapsible wall and is adapted to sustain high fluid pressure. The diameter of the hose 530*a* when pressurized, is substantially greater than the depth of the support channel 522*a* or the depth of the piston 532*a*, which ever is greater. In this arrangement, when the hose is depressurized it may be collapsed within the confines of the support channel 522*a*; when it is pressurized it will lift the piston 532*a* relative to the support channel 522*a* until the hose becomes circular in cross-section. Thus, the rail 520*a* is advanced in the transverse direction by pressurizing the hose 530*a*** and it is retracted by depressurizing the hose.

The control system for the hose **530*a* is shown in FIG. 8. It comprises a solenoid valve 540 which is of the same structure as the valve 210 of FIG. 4. The valve 540 has a pressure inlet port 542 which is adapted to be connected with the conduit 220 from the sequence valve 200. It has a drain port 544 connected to the sump. The solenoid valve 540 has a valve port 546 which is coupled with the port 548*a* of hose 530*a* and the port 548*a*' of the hose 530*a*' through an hydraulic circuit including a check valve 552 and a parallel connected flow restrictor 553. The solenoid valve 540 also has a valve port 554 coupled with the port 556*b* of hose 530*b* and the port 556*b*' of the hose 530*b*' through an hydraulic circuit including a check valve 558 and a parallel connected flow restrictor 562. The solenoid valve 540 is controlled by a solenoid actuator 564 which is connected through the conductor 348 to the switch 344 of the pressure responsive switch 202. The valve also has a solenoid actuator 566 which is connected through the conductor 354 to the switch 346 of the pressure responsive switch 202**.

The operation of the second embodiment will be described with reference to FIGS. 5, 6 and 7. It will be assumed that the pressure responsive switch 202 is in the condition shown in FIG. 4 and hence the solenoid actuator 564 is energized and the solenoid actuator 566 deenergized. Accordingly, at start up the supply pressure from the conduit 214 is supplied through the sequence valve 200 to the inlet port 542 of the solenoid valve 540. The hoses **530*a* and 530*a*' are pressurized through the check valve 552 and the rails 520*a* and 520*a*' are advanced toward the workpiece; at the same time, the hoses 530*b* and 530*b*' are connected with the sump through the flow restrictor 562 and the valve port 554 and are depressurized, which allows the hoses to collapse. When the rails 520*a* and 520*a*' advance sufficiently to cause the tracks 110 and 110' to engage the workpiece the pressure in the supply conduit 214 increases and the sequence valve 200 is actuated. This connects the pressure supply conduit 214 to the solenoid valve 212 and the longitudinal actuation of the rails 520*a* and 520*a*' is commenced. When the rails 520*a* and 520*a*' reach the end of the stroke, the pressure in the conduit 232 increases and the pressure responsive switch 202 is actuated so that the switch 344 is opened and switch 346 is closed. This completes the first half-cycle of the press and it is in readiness for the initiation of the second half-cycle. In the second half-cycle, the hoses 530***a* and 530*a'* are depressurized and the hoses 530*b* and 530*b'* are pressurized. This causes the rails 520*b* and 520*b'* to be advanced causing the tracks 110 and 110' to engage the workpiece. As a result, the sequence valve 200 admits pressure to the solenoid valve 212 and the rails 520*b* and 520*b'* are advanced and at the same time, the rails 520*a* and 520*a'* are retracted. When the rails 520*b* and 520*b'* reach the end of the actuation stroke, the pressure in conduit 232 increases and the pressure responsive switch 202 is actuated. This closes switch 344 and opens switch 346 which reverses the energization of the solenoids 212 and 540. This completes the second half-cycle of operation and the press is in readiness for the next half-cycle which is a repetition of the first-half cycle described above. The press continues to run in this manner so long as it remains energized.

Although the description of this invention has been given with reference to a particular embodiment, it is not to be construed in the limiting sense. Many variations and modifications will now occur to those skilled in the art. For a definition of the invention, reference is made to the appended claims.

What is claimed is:

1. A press for simultaneously pressing and conveying a workpiece from an input to an output, a set of rails disposed side by side, a reaction member disposed opposite said set of rails in spaced relation and adapted to accept a workpiece between the set of rails and said member, first and second transverse actuating means connected respectively with a first group and a second group of said set of rails and adapted to alternately advance and retract said first group and said second group of rails relative to said rection member to alternately press and release said workpiece, first and second longitudinal actuating means connected respectively with said first group and said second group of rails and adapted for alternately advancing and retracting said first group and said second group of rails relative to said output to move said workpiece toward the output, and energizing means for energizing the first transverse actuating means and the first longitudinal actuating means in the advancing direction while energizing the second transverse actuating means and the second longitudinal actuating means in the retracting direction and vice versa, whereby said first group and said second group of rails alternately press and advance the workpiece, each of said first and second transverse actuating means being comprised of one or more fluid pressure actuators and each of said first and second longitudinal actuating means being comprised of one or more fluid pressure actuators.

2. The invention as defined in claim 1 wherein the actuators comprising the transverse actuating means are hydraulic pistons and wherein the actuators comprising the longitudinal actuating means are hydraulic pistons.

3. The invention as defined in claim 1 wherein the actuators comprising said transverse actuating means are collapsible hydraulic hoses and wherein the actuators comprising said longitudinal actuating means are hydraulic pistons.

4. The invention as defined in claim 1 wherein said reaction member comprises a second set of rails disposed side by side, third and fourth transverse actuating means connected respectively with a first group and second group of rails in said second set of rails, said energizing means being adapted to energize said third transverse actuating means simultaneously with and in the same direction as said first transverse actuating means and to energize said fourth transverse actuating means simultaneously with and in the same direction as said second transverse actuating means, first driving means for advancing and retracting the first group of rails in said second set in synchronism with the first group of rails in the first mentioned set, and second driving means for advancing and retracting the second group of rails in said second set in synchronism with the second set of rails in the first mentioned set.

5. The invention as defined in claim 4 including a support frame having first and second transversely opposite support members with said first mentioned set of rails and the second set of rails being disposed therebetween, said first and second transverse actuating means being connected with said first support member, said third and fourth transverse actuating means being connected with said second support member, said support frame also having first and second longitudinally opposite support members with said first mentioned set of rails and said second set of rails being disposed therebetween, the first and second longitudinal actuating means being connected respectively with the first and second longitudinally opposite support members, and a first endless track encircling the first mentioned set of rails and a second endless track encircling the second set of rails, said tracks being adapted to receive said workpiece therebetween.

6. The invention as defined in claim 5 including first and second rollers disposed at opposite ends respectively of the first mentioned set of rails, said first track including a first endless link belt supported on said first and second rollers and being in engagement with said first set of rails, third and fourth rollers disposed at opposite ends respectively of said second set of rails, said second track including a second endless belt supported on said third and fourth rollers and being in engagement with said second set of rails, said link belts each comprising multiple links in the form of rigid bars spanning the respective sets of rails.

7. The invention as defined in claim 6 wherein said first track also includes a first endless sheet belt encircling said first endless link belt and being movable therewith, and wherein said second track includes a second endless sheet belt encircling said second link belt and being movable therewith.

8. The invention as defined in claim 1 wherein said energizing means comprises advancing and retracting control means for energizing said longitudinal actuating means in the advancing direction in response to a predetermined pressure in said transverse actuating means and for simultaneously energizing said longitudinal actuating means and said transverse actuating means in the retracting direction.

9. The invention as defined in claim 8 wherein said retracting control means for energizing said transverse actuating means and said longitudinal actuating means in the retracting direction comprises pressure responsive means responsive to a predetermined pressure in said longitudinal actuating means.

10. The invention as defined in claim 8 wherein said control means includes means for restricting the flow rate to said longitudinal actuating means and said transverse actuating means when they are energized in the retracting direction.

11. The invention as defined in claim 5 including first and second roller means for supporting said first and second endless tracks, respectively, and means for mounting said first and second roller means on said support frame for maintaining said respective first and second tracks at predetermined tension for various positions of said rails.

* * * * *